US010648269B2

(12) United States Patent
Painter et al.

(10) Patent No.: US 10,648,269 B2
(45) Date of Patent: May 12, 2020

(54) SINGLE LINE APPARATUS, SYSTEM, AND METHOD FOR FRACTURING A MULTIWELL PAD

(71) Applicant: Chevron U.S.A. Inc., San Ramon, CA (US)

(72) Inventors: Jay Painter, Houston, TX (US); Christopher Champeaux, Houston, TX (US); Doug Scott, Houston, TX (US)

(73) Assignee: CHEVRON U.S.A. INC., San Ramon, CA (US)

( * ) Notice: Subject to any disclaimer, the term of this patent is extended or adjusted under 35 U.S.C. 154(b) by 3 days.

(21) Appl. No.: 16/123,333

(22) Filed: Sep. 6, 2018

(65) Prior Publication Data

US 2019/0071946 A1 Mar. 7, 2019

Related U.S. Application Data

(60) Provisional application No. 62/555,315, filed on Sep. 7, 2017.

(51) Int. Cl.

| | |
|---|---|
| ***E21B 33/068*** | (2006.01) |
| ***E21B 17/05*** | (2006.01) |
| ***E21B 34/02*** | (2006.01) |
| ***E21B 43/26*** | (2006.01) |
| ***E21B 21/02*** | (2006.01) |

(52) U.S. Cl.
CPC ..... *E21B 33/068* (2013.01); *E21B 17/05* (2013.01); *E21B 21/02* (2013.01); *E21B 34/02* (2013.01); *E21B 43/26* (2013.01)

(58) Field of Classification Search
None
See application file for complete search history.

(56) References Cited

U.S. PATENT DOCUMENTS

| | | | | |
|---|---|---|---|---|
| 8,800,667 | B2 * | 8/2014 | Seim | E21B 33/035 166/313 |
| 8,905,056 | B2 * | 12/2014 | Kendrick | E21B 21/062 137/15.01 |
| 9,068,450 | B2 * | 6/2015 | Guidry | E21B 33/03 |
| 2013/0175039 | A1 | 7/2013 | Guidry | |
| 2018/0179848 | A1 * | 6/2018 | Cherewyk | E21B 33/068 |
| 2018/0347286 | A1 * | 12/2018 | Scott | E21B 17/021 |

* cited by examiner

*Primary Examiner* — Matthew R Buck
*Assistant Examiner* — Douglas S Wood
(74) *Attorney, Agent, or Firm* — King & Spalding LLP

(57) ABSTRACT

A system for distributing pressurized fluid during wellbore operations can include a pressure vessel having a fluid inlet and a fluid outlet. The system can also include a conduit rotatably connected to the fluid outlet of the pressure vessel for coupling to one or more wellbores. Also, a method for distributing pressurized fluid during wellbore operations can include receiving pressurized fluid in a pressure vessel. The method can also include distributing to one or more wellbores the pressurized fluid from the pressure vessel through a conduit rotatably connected to the pressure vessel.

19 Claims, 4 Drawing Sheets

SINGLE LINE APPARATUS, SYSTEM, AND METHOD FOR FRACTURING A MULTIWELL PAD

CROSS-REFERENCE TO RELATED APPLICATIONS

This application claims priority under 35 U.S.C. § 119 to U.S. Provisional Patent Application Ser. No. 62/555,315, titled "Single Line Apparatus, System, and Method For Fracturing a Multiwell Pad" and filed on Sep. 7, 2017, the entire contents of which are hereby incorporated herein by reference.

TECHNICAL FIELD

The present disclosure relates generally to apparatus, systems, and methods of fracturing a multiwell pad using only a single line.

BACKGROUND

It is very common to use a manifold system for efficiency when completing stimulation activity on a multiple well pad in connection with hydraulic fracturing at a drilling site. Typical manifold systems are intrinsically connected where high pressure sections are isolated by a valve or other pressure controlling mechanism. The fracturing fluid supply, provided by fracturing trucks for example, is pumped into a connector. The connector is connected to a fracturing manifold which takes the fracturing fluid input and outputs one line per well on the well pad. Each well is isolated from the manifold by a valve and additional valves may be found in the manifold itself. When fracturing, every valve but the valves leading to the well to be fractured are closed.

For example, FIG. 1 illustrates a common set up of a fracturing system 101 of the prior art in a four well pad 105. Each well in a multiwell pad gets fractured multiple times. In an example with four wells and 40 fracturing zones per well, the wells in a multiwell pad are fractured a total of 160 times. When fracturing the well pad, first, well A and the fracturing fluid pump 110 are isolated through the valves so that fracturing fluid only goes into well A. For example, valves B, C, and D would be closed while valve A is open, effectively isolating wells B, C, and D from the fracturing. Once well A is fractured, valve A is closed, well A is plugged and the next fracturing zone is perforated. Valve B is then opened allowing fracturing fluid to be pumped into well B, while well A, C, and D are isolated. This process is repeated cycling through each well. In the example of four wells and 40 fracturing zones per well, the process involving opening and closing valves to complete each fracturing stage would be repeated 160 times.

Each well has a fracturing tree and the fracturing trees within a pad are usually about evenly spaced; however, the spacing can vary by a couple of feet, the elevation of each tree can also vary by a couple of feet, and the angle of the tree may vary by a few degrees. This arrangement makes it such that connecting the valve to the tree is complex and can require multiple lines, multiple swivel joints, and/or expandable pipes, each individually adjusted, in order to properly connect the manifold 115 to each tree in the well pad. These connections tend to comprise 6 or more connectors or "legs" per connection from the manifold to the tree in order to generate the number of degrees of freedom needed to properly connect the manifold to the fracturing trees.

Further, when using a manifold, if a valve fails while fracturing through a manifold, other sections of the manifold may become unintentionally pressurized leading to no go zones and slowing the rate at which the well can go into production. As such, when actively fracturing a well, an exclusion zone exists around a well pad such that no other workover operations, such as perforation and plugging, can be performed on other wells in the pad. The exclusion zone requirement increases the time needed to fracture all zones, reducing the overall efficiency of the fracturing job.

The existing manifold designs require many adjustable connecting components in order to provide the required number of degrees of freedom for the manifold. Further, using a manifold leads to the potential for an unintended section to become pressurized. The current disclosure describes a solution which provides the same degrees of freedom with fewer connecting components through the ability to have a dynamic connection system. Further, the current disclosure provides a system that removes the need for exclusion zones as it does not include a manifold. The design of the current disclosure leads to more efficient fracturing operations.

SUMMARY

In general, in one aspect, the disclosure relates to a system for distributing pressurized fluid during wellbore operations. The system can include a pressure vessel having a fluid inlet and a fluid outlet. The system can also include a conduit rotatably connected to the fluid outlet of the pressure vessel for coupling to one or more wellbores.

In another aspect, the disclosure can generally relate to a well selection system for selectively delivering a pressurized fluid to a multiwell field during wellbore operations. The system can include a pressure vessel that is configured to couple to a fluid inlet through which the pressurized fluid flows from a pressurized fluid pump. The system can also include a conduit movably coupled to the pressure vessel, wherein the conduit comprises a first end and a second end, wherein the first end is coupled to the pressure vessel, and wherein the second end is configured to detachably couple to a plurality of attachment points of a plurality of wells. The second end of the conduit is configured to move relative to the fluid inlet to be in a position to couple to an attachment point of the plurality of attachment points. The second end of the conduit, when coupled to the attachment point of one of the plurality of wells, is unable to couple to the attachment point of a remainder of the plurality of wells.

In yet another aspect, the disclosure can generally relate to a method for distributing pressurized fluid during wellbore operations. The method can include receiving pressurized fluid in a pressure vessel. The method can also include distributing to one or more wellbores the pressurized fluid from the pressure vessel through a conduit rotatably connected to the pressure vessel.

These and other aspects, objects, features, and embodiments will be apparent from the following description and the appended claims.

BRIEF DESCRIPTION OF THE DRAWINGS

The drawings illustrate only example embodiments of methods, systems, and devices for single line fracturing of a multiple well drilling pad and are therefore not to be considered limiting of its scope, as they may admit to other equally effective embodiments. The elements and features shown in the drawings are not necessarily to scale, emphasis instead being placed upon clearly illustrating the principles of the example embodiments. Additionally, certain dimensions or positionings may be exaggerated to help visually convey such principles. In the drawings, reference numerals designate like or corresponding, but not necessarily identical, elements.

DETAILED DESCRIPTION OF EXAMPLE EMBODIMENTS

Figure 1:
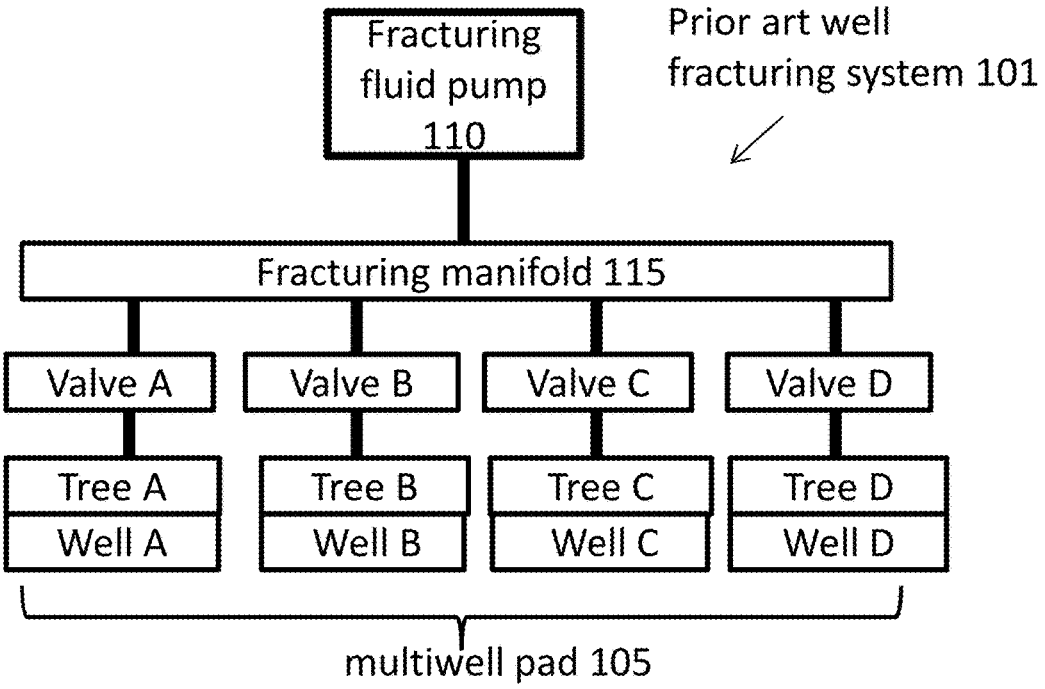
Fig. 1 Prior art
FIG. 1 illustrates a prior art system for fracturing a multiwell pad.

The example embodiments discussed herein are directed to systems, apparatus, and methods of fracturing multiple wells using a single line. Example embodiments of the disclosure will be described more fully hereinafter with reference to the accompanying drawings, in which example embodiments of apparatus, methods, and systems for single line fracturing of wells are illustrated. The apparatus, systems, and methods may, however, be embodied in many different forms and should not be construed as limited to the example embodiments set forth herein. Rather, these example embodiments are provided so that this disclosure will be thorough and complete, and will fully convey the scope of the systems, methods, and apparatus to those of ordinary skill in the art. Like, but not necessarily the same, elements in the various figures are denoted by like reference numerals for consistency.

Terms such as "first," "second," "end," "inner," "outer," "distal," and "proximal" are used merely to distinguish one component (or part of a component or state of a component) from another. Such terms are not meant to denote a preference or a particular orientation. Also, the names given to various components described herein are descriptive of one embodiment and are not meant to be limiting in any way. Those of ordinary skill in the art will appreciate that a feature and/or component shown and/or described in one embodiment (e.g., in a figure) herein can be used in another embodiment (e.g., in any other figure) herein, even if not expressly shown and/or described in such other embodiment. "About," and "substantially," as used herein prior to a number, refers to an amount that is within 3 percent of the number listed. A "plurality," as used herein, refers to two or more.

"Connected," as used herein, refers to directly or indirectly connecting two pipes to form a conduit, i.e. the two pipes can be directly attached (for example, threaded together), attached through a joint, or there can be other pipes between the two pipes as long as they can form a single conduit between the two pipes.

"Attached," as used herein, refers to connecting two pipes through a direct connection, a valve, or a joint to form a conduit, in other words, there are no other pipes between the two pipes.

A "single line," as used herein, refers to a single conduit between the two ends of the line, i.e. there is no manifold or branching pipes between the two end points of the line. For example, an inlet pipe that connects a series of pipes to one outlet pipe is a single line, even if a valve is placed between the pipes in the line. An inlet pipe that connects to multiple outlet pipes, even if there are valves therebetween that can separate the lines from fluid communication, is not a single line.

"Pipe," as used herein, refers to a hollow tube with attachment points on either end, the tube may be straight or curved and the pipe may be of an adjustable length. Line and conduit are used throughout interchangeably.

Figure 2:
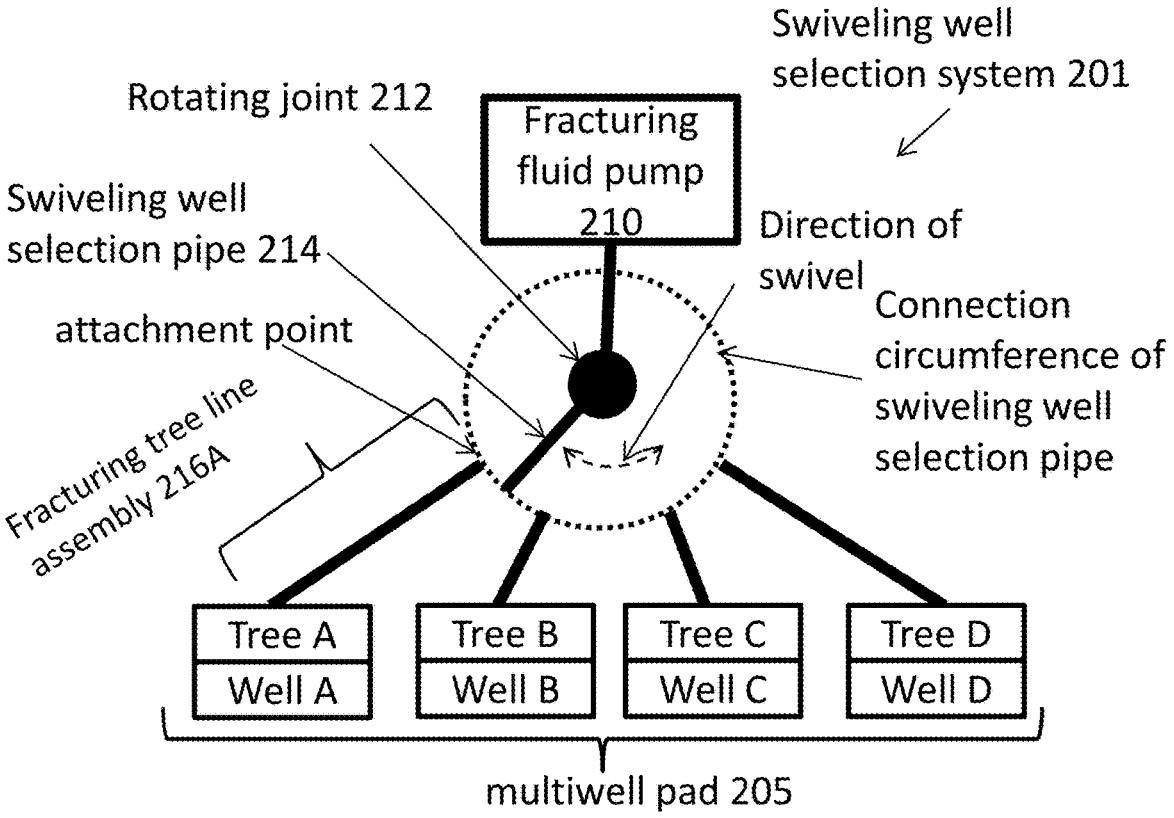
FIG. 2 illustrates a generic embodiment of a system for fracturing a multiwell pad in accordance with the example embodiments of the present disclosure.

FIG. 2 illustrates a general embodiment of the single line fracturing system using a swiveling well selection system 201 in accordance with the example embodiments of the present disclosure. The fracturing fluid pump 210 is connected through a rotating joint 212 to a swiveling well selection pipe 214. The swiveling well selection pipe 214 is able to be swiveled around the rotating joint 212 and connected individually to each fracturing tree (A, B, C, or D) in the well pad 205. For example, when fracturing the well pad 205, first, the swiveling well selection pipe 214 is connected to the fracturing tree line assembly 216A of well A, forming a single line between the fracturing fluid pump 210 and well A. As well A is being fractured, workover operations can be performed at wells B, C, and D providing for greater efficiency. Once well A is fractured, the swiveling well selection pipe 214 is disconnected from the fracturing tree line assembly 216A, is swiveled along the direction of swivel, so it lines up with the fracturing tree line assembly of well B, and attached to the fracturing tree line assembly of well B. Well B is then fractured. As well B is being fractured, workover operations can be performed at wells A, C, and D, as no exclusion zone is needed on the well pad 205. This process is repeated cycling through each well.

In one embodiment, the fracturing tree line assembly of each well is a single line. Each fracturing tree line assembly can have two or more connectors or "legs" allowing two or more degrees of freedom. Each fracturing tree line assembly will conclude at the attachment point. The attachment point is the point at which the fracturing tree line assembly can attach to the swiveling well selection pipe 214. The system including the swiveling well selection pipe 214 is able to quickly make and break the fracturing tree line assembly attachment between fracturing stages. This allows one or more fewer legs for articulation and mitigates the risk of an unintended wells becoming pressurized since all other sections are physically disconnected from the fracturing fluid pump 210.

Figure 3:
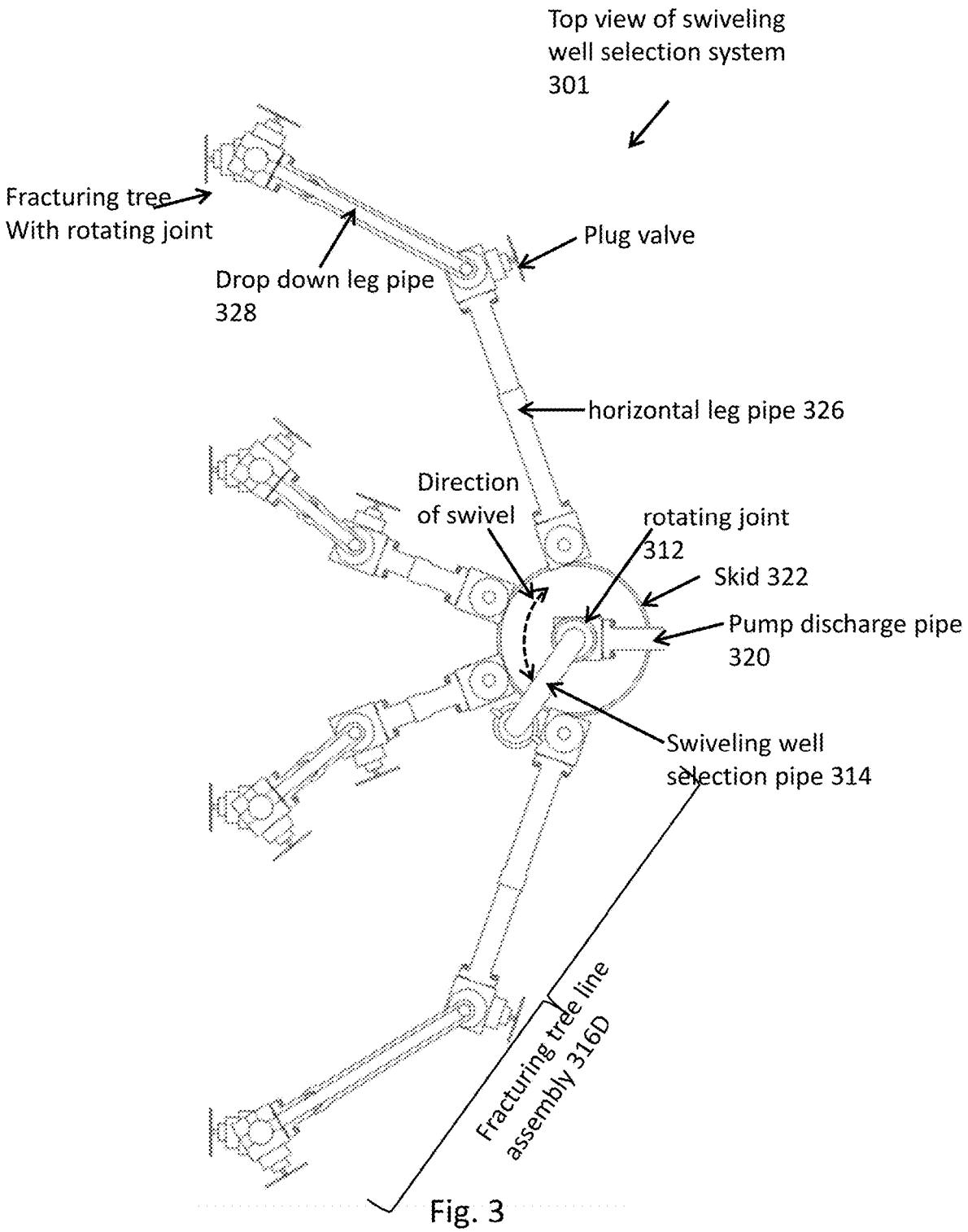
FIG. 3 is the top view of an embodiment of a system for fracturing a multiwell pad in accordance with the example embodiments of the present disclosure.
Figure 4:
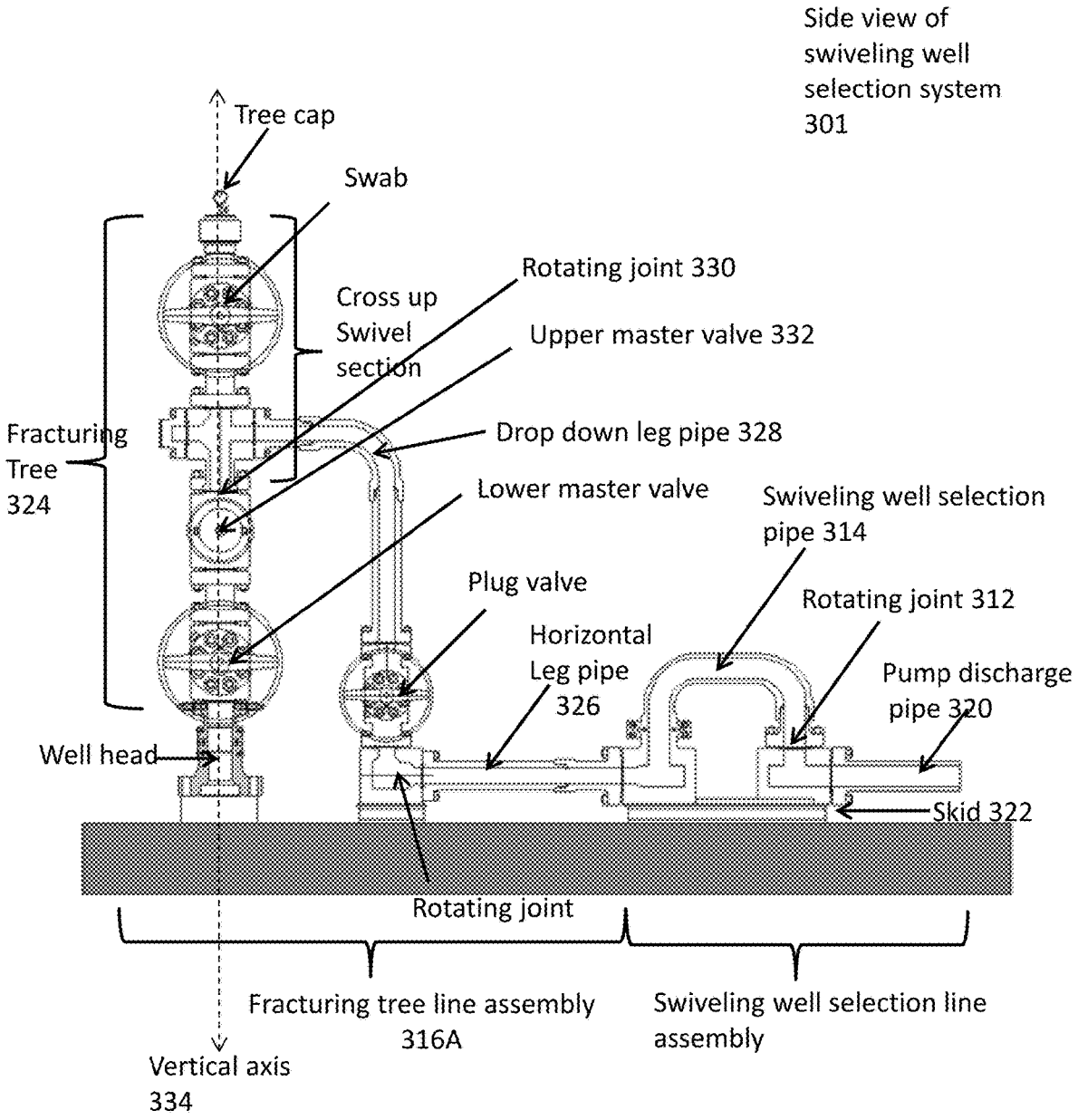
FIG. 4 is a side view of an embodiment of a system for fracturing a multiwell pad in accordance with the example embodiments of the present disclosure.

FIGS. 3 and 4 illustrate a specific embodiment of the swiveling well selection system. FIG. 3 is a top view of the embodiment, while FIG. 4 is a side view. For clarity, FIG. 4 illustrates only one fracturing tree line assembly 316A connected to the swiveling well selection system 301 on only one well for clarity. The swiveling well selection system 301 comprises a pump discharge pipe 320 which can be connected to a fracturing fluid pump, such as from fracturing fluid trucks (not shown). The outlet side of the pump discharge pipe 320 is attached to a rotating joint 312 which is further connected to a swiveling well selection pipe 314, allowing the swiveling well selection pipe to swivel in the direction of swivel. The pump discharge pipe 320, rotating joint 312 and swiveling well selection pipe 314 can be mounted on a skid, such as a circular skid 322. The circumference of the skid is located such that the attachment end of the swiveling well selection pipe 314 overhangs the skid 322 so that the attachment end will line up with any joints abutting the skid 322. The swiveling well selection pipe 314 is able to swivel around the rotating joint 312 such that it can be connected to any joint abutting the skid. The swiveling well selection pipe 314 swivels in a fixed moment and, thus, adds additional degrees of freedom to the system, so that fewer legs are needed to connect the fracturing tree 324 to the pump discharge pipe 320 than are found in conventional fracturing connections. As shown in FIG. 3, four fracturing tree line assemblies are located with one end abutting the skid 322 and the other end connected to each of the respective fracturing trees (FIG. 3). Each fracturing tree line assembly in the example embodiment comprises a horizontal leg pipe 326 and a drop down leg pipe 328. The horizontal leg pipe 326 can comprise one or more pipes, valves or joints. The drop down leg pipe 328 may also comprise one or more pipes, valves or joints. Additionally, the horizontal leg pipe 326 can be attached to or connected to the drop down leg pipe 328. A valve or joint may be located between the horizontal leg pipe 326 and the drop down leg pipe 328. When the swiveling well selection pipe 314 is attached to a fracturing tree line assembly 316A, a single line is formed between the pump discharge pipe 320 and the fracturing tree 324 connected to the swiveling well selection assembly. A valve on the fracturing tree allows for a well isolation during workover operations.

In one embodiment, the fracturing trees within the well pad are rotatable. That is, the rotating fracturing trees may have a rotating joint 330 within the tree above the upper master valve 332 such that at least a portion of the tree is rotatable around a vertical axis 334. The addition of a rotating fracturing tree portion allows an additional degree of freedom within the system so that fewer legs are needed between the fracturing tree and the pump discharge pipe than in a conventional system. Using both the swiveling well selection pipe and a rotatable fracturing tree, the number of degrees of freedom needed between the fracturing tree and pump discharge pipe are reduced from 6-7 legs in a manifold set up to 2-3 legs in the swiveling well selection system. Each well pad can comprise 2 wells, 3 wells, 4 wells, 5 wells, 6 wells, 7 wells, or 8 wells, for example. Additionally, the system can be set up connecting only a portion of wells in a well pad to the system. For example, 4 wells in an 8 well pad may connected to one swiveling well selection assemblies. The other 4 wells may be connected to a different swiveling well selection assembly. The system, methods, and apparatus described in the disclosure may be used at up to 10,000 psi, 15,000 psi, and 20,000 psi.

Figure 5:
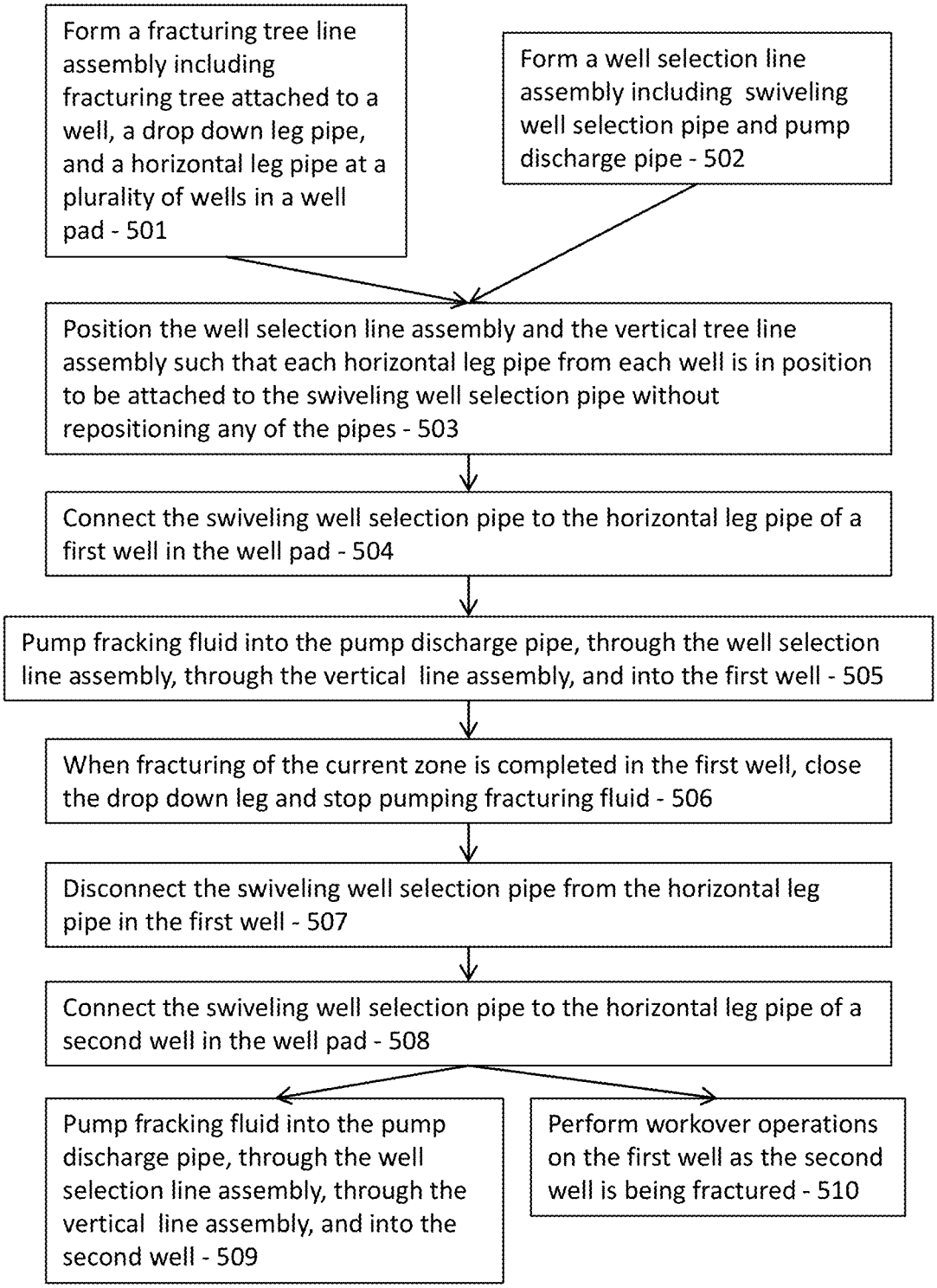
FIG. 5 is a flow chart of a method for single line fracturing of a multiwell pad in accordance with the example embodiments of the present disclosure.

FIG. 5 is a flow chart representing an embodiment of a method of the disclosure. In step 501, a fracturing tree line assembly is formed at each well in a well pad and includes a fracturing tree attached to a well, a drop down leg pipe and a horizontal leg pipe. In step 502, a well selection line assembly is formed which includes a swivel well selection pipe and a pump discharge pipe. In step 503, the two lines are positioned such that each horizontal leg pipe from each well is in position to be attached to the swiveling selection pipe without repositioning any of the pipes. For example, the horizontal leg pipes can be positioned against a circular skit surrounding the swiveling selection pipe such that the swiveling selection pipe can easily attach to each horizontal leg pipe in turn without further repositioning of any of the pipes in the system. In step 504, the swiveling well selection line assembly can then be attached to the horizontal leg pipe of a first well in the well pad. In step 505, the first well is fractured. With the swiveling well selection system of the example embodiments described herein, as the first well is fractured, workover operations can occur at the other wells in the well pad. In step 506, once the well is fractured, a valve can be closed between the well selection pipe and the tree, isolating the tree. In step 507, the swiveling selection pipe assembly is then disconnected from the horizontal leg pipe in the first well and swiveled such that it lines up with the horizontal leg pipe of the second well. In step 508, the horizontal leg pipe of the second well is attached to the swiveling selection pipe assembly and the second well is then fractured. As the second well is fractured in step 509, workover operations on the first well and other wells in the well pad may occur in step 510. The process is repeated for each well in each fracturing stage, rotating between the wells until all fracturing zones in each well are fractured. The wells can then be produced. Workover operations can include perforating, plugging, and cleaning, for example. It should be appreciated that the steps of the foregoing method illustrated in FIG. 5 may be altered in other embodiments of the disclosure.

The methods, apparatus, and system of the disclosure can lead to multiple advantages over current fracturing methods, apparatus, and systems, as the embodiments of the disclosure do not include a manifold between the input line of fracturing fluid and the individual trees at each well in the well pad. Specific advantages include (1) physical separation between legs being stimulated with a quick connection leading to a quicker time to production {estimated 1.5-2.5 days quicker on 4 well pad at 100 stages), (2) reduce valves rented and reworked by 30+%, (3) reduce connectors on site by 30+%, and/or (4) reduced statistical risk of failure.

What is claimed is:

1. A system for distributing pressurized fluid during wellbore operations, the system comprising:

a pressure vessel having a fluid inlet and a fluid outlet, wherein the fluid outlet comprises a rotatable joint; and a conduit having a first end and a second end, wherein the first end of the conduit is connected to the rotatable joint of the fluid outlet of the pressure vessel, wherein the conduit rotates about the fluid outlet of the pressure vessel, wherein the second end of the conduit has a plurality of positions relative to the rotatable joint of the pressure vessel, wherein each position of the plurality of positions corresponds to an attachment point of a wellbore of a plurality of wellbores, wherein the second end of the conduit is configured to detachably couple to each attachment point of the plurality of wellbores, and wherein the pressure vessel is stationary relative to the plurality of wellbores.

2. The system of claim 1, wherein the fluid inlet is fixedly coupled to the pressure vessel.

3. The system of claim 1, wherein the pressure vessel is mounted on a platform.

4. The system of claim 1, wherein the fluid inlet rotates relative to the pressure vessel.

5. The system of claim 1, further comprising:

a pressurized fluid pump coupled to the fluid inlet, wherein the pressurized fluid pump delivers the pressurized fluid through the pressure vessel and the fluid outlet to the plurality of wellbores.

6. The system of claim 1, wherein the conduit has an inverted U shape.

7. The system of claim 1, wherein each wellbore of the plurality of wellbores comprises a tree line assembly that is configured to couple to the second end of the conduit, wherein the tree line assembly of one wellbore of the plurality of wellbores is movable relative to a remainder of the plurality of wellbores.

8. The system of claim 7, wherein the tree line assembly of each wellbore comprises a horizontal leg pipe, a down leg pipe, and a fracturing tree.

9. The system of claim 8, wherein the tree line assembly further comprises a first rotating joint disposed between the horizontal leg pipe and the down leg pipe.

10. The system of claim 9, wherein the tree line assembly further comprises a second rotating joint disposed between the fracturing tree and the down leg pipe.

11. The system of claim 10, wherein the tree line assembly further comprises a master valve adjacent to the second rotating joint.

12. A well selection system for selectively delivering a pressurized fluid to a multiwell field during wellbore operations, the system comprising:

a pressure vessel that is configured to couple to a fluid inlet through which the pressurized fluid flows from a pressurized fluid pump; and a conduit movably coupled to a rotatable joint of a fluid outlet of the pressure vessel, wherein the conduit comprises a first end and a second end, wherein the first end is coupled to the rotatable joint of the pressure vessel, wherein the second end is configured to detachably couple to a plurality of attachment points of a plurality of wells of the multiwell field, wherein the conduit rotates about the rotatable joint of the fluid outlet of the pressure vessel to a plurality of positions, wherein each position of the plurality of positions corresponds to an attachment point of the plurality of attachment points, wherein the second end of the conduit is configured to rotate relative to the rotatable joint of the fluid inlet to detachably couple to the plurality of attachment points, wherein the second end of the conduit, when coupled to the attachment point of one of the plurality of wells, is unable to couple to the attachment point of a remainder of the plurality of wells, and wherein the pressure vessel is stationary relative to the plurality of wells.

13. The system of claim 12, wherein the fluid inlet rotates relative to the pressure vessel.

14. The system of claim 12, wherein the conduit has an inverted U shape.

15. A method for distributing pressurized fluid during wellbore operations, the method comprising:

receiving pressurized fluid in a pressure vessel;

selecting a first wellbore of a plurality of wellbores to receive the pressurized fluid;

rotating a conduit of a multiwell selection system to a first position of a plurality of positions, wherein the first position corresponds to the first wellbore, wherein the conduit comprises a first end and a second end, wherein the first end is coupled to a rotatable joint of a fluid outlet of the pressure vessel, wherein the second end rotates about the rotatable joint, wherein the pressure vessel is stationary relative to the plurality of wellbores;

detachably coupling the second end of the conduit to a first attachment point of the first wellbore; and distributing the pressurized fluid from the pressure vessel through the conduit to the first wellbore at a first time.

16. The method claim 15, further comprising:

decoupling the second end of the conduit from the first attachment point of the first wellbore;

rotating the conduit relative to the pressure vessel to a second position of the plurality of positions;

coupling the second end of the conduit to a second attachment point of a second wellbore of the plurality of wellbores; and distributing the pressurized fluid through the conduit to the second wellbore at a second time.

17. The method of claim 16, wherein the first well undergoes a workover operation while the pressurized fluid is distributed to the second wellbore.

18. The method of claim 15, wherein each wellbore of the plurality of wellbores comprises a tree line assembly that is moved to place the tree line assembly in one of the plurality of positions for coupling to the second end of the conduit.

19. The method of claim 15, wherein the pressurized fluid is used for a fracturing operation of the plurality of wellbores.

* * * * *